US010816236B2

(12) United States Patent
Winders et al.

(10) Patent No.: US 10,816,236 B2
(45) Date of Patent: Oct. 27, 2020

(54) CONDENSATE RECYCLING SYSTEM FOR HVAC SYSTEM

(71) Applicant: Johnson Controls Technology Company, Auburn Hills, MI (US)

(72) Inventors: Daniel V. Winders, Columbia, SC (US); Neelkanth S. Gupte, Katy, TX (US); Vilas G. Pawanarkar, Pune (IN); Kirankumar A. Muley, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 122 days.

(21) Appl. No.: 16/000,291

(22) Filed: Jun. 5, 2018

(65) Prior Publication Data

US 2018/0356116 A1 Dec. 13, 2018

Related U.S. Application Data

(60) Provisional application No. 62/517,742, filed on Jun. 9, 2017.

(51) Int. Cl.

| | |
|---|---|
| ***F24F 11/85*** | (2018.01) |
| ***F24F 3/14*** | (2006.01) |
| ***F24F 13/22*** | (2006.01) |
| ***F24F 11/30*** | (2018.01) |

(52) U.S. Cl.

CPC ..... *F24F 11/85* (2018.01); *F24F 3/1405* (2013.01); *F24F 13/22* (2013.01); *F24F 11/30* (2018.01); *F24F 2003/1446* (2013.01); *F24F 2013/221* (2013.01); *F24F 2013/228* (2013.01)

(58) Field of Classification Search

CPC .. F24F 11/30; F24F 11/85; F24F 13/22; F24F 2003/1446; F24F 2013/221; F24F 2013/228; F24F 3/1405

See application file for complete search history.

(56) References Cited

U.S. PATENT DOCUMENTS

| | | | | |
|---|---|---|---|---|
| 3,662,557 | A * | 5/1972 | Morgan | F24F 13/22 62/279 |
| 4,490,990 | A * | 1/1985 | Chastine | F25D 21/14 62/279 |
| 5,682,757 | A * | 11/1997 | Peterson | F24F 13/22 62/259.2 |
| 5,979,172 | A | 11/1999 | Teller | |
| 6,751,975 | B1 | 6/2004 | Reimann | |
| 6,871,507 | B1 * | 3/2005 | Goldsmith | F24F 1/06 62/183 |
| 7,757,499 | B2 | 7/2010 | Jensen | |
| 8,169,314 | B2 * | 5/2012 | Cantolino | F24F 13/222 340/506 |
| 8,840,729 | B1 * | 9/2014 | Herren | F24F 13/222 134/15 |

(Continued)

*Primary Examiner* — Henry T Crenshaw
(74) *Attorney, Agent, or Firm* — Fletcher Yoder, P.C.

(57) ABSTRACT

Embodiments of the present disclosure relate to a climate management system that includes a condensate pan configured to collect condensate from a first heat exchanger of the climate management system, a pump fluidly coupled to the condensate pan, and a nozzle fluidly coupled to the pump, wherein the nozzle is configured to receive the condensate from the pump and direct the condensate toward an airflow across a second heat exchanger of the climate management system.

24 Claims, 6 Drawing Sheets

(56) References Cited

U.S. PATENT DOCUMENTS

| | | | | |
|---|---|---|---|---|
| 2003/0221440 | A1* | 12/2003 | Limehouse | F24F 1/06 62/305 |
| 2009/0134074 | A1* | 5/2009 | Doran | C02F 9/005 210/85 |
| 2009/0243527 | A1* | 10/2009 | Kakiuchi | F24F 3/1405 318/434 |
| 2010/0212346 | A1 | 8/2010 | Bourne et al. | |
| 2011/0120171 | A1* | 5/2011 | Cho | F28B 1/06 62/428 |
| 2011/0192188 | A1* | 8/2011 | Nickey | F24F 13/30 62/507 |
| 2011/0197617 | A1 | 8/2011 | Hwang et al. | |
| 2011/0308618 | A1 | 12/2011 | Lorenz | |
| 2013/0333413 | A1* | 12/2013 | Lord | F24F 3/044 62/498 |
| 2014/0069134 | A1* | 3/2014 | Grabon | F24F 12/00 62/305 |
| 2014/0102123 | A1* | 4/2014 | Cantolino | F24F 13/222 62/150 |

* cited by examiner

CONDENSATE RECYCLING SYSTEM FOR HVAC SYSTEM

CROSS REFERENCE TO RELATED APPLICATIONS

This application claims priority from and the benefit of U.S. Provisional Application Ser. No. 62/517,742, entitled "PACKAGED UNIT CONDENSATE RECLAMATION SYSTEM," filed Jun. 9, 2017, which is hereby incorporated by reference in its entirety for all purposes.

BACKGROUND

The present disclosure relates generally to environmental control systems, and more particularly, to a condensate recycling system for a heating, ventilation, and air conditioning (HVAC) system.

Environmental control systems are utilized in residential, commercial, and industrial environments to control environmental properties, such as temperature and humidity, for occupants of the respective environments. The environmental control system may control the environmental properties through control of an airflow delivered to the environment. In some cases, environment control systems may generate condensate during a dehumidification process and/or when ambient air is cooled via an evaporator coil. Traditionally, condensate generated during operation of existing environmental control systems is directed to a drainage line of a building or other structure via pipes or conduits. Unfortunately, connecting a condensate pan to the drainage line of the building or other structure may be time consuming and expensive. Further, existing environmental control systems generally dispose of the condensate, such that the condensate is not recycled and/or otherwise utilized by the environmental control system.

SUMMARY

In one embodiment of the present disclosure, a climate management system includes a condensate pan configured to collect condensate from a first heat exchanger of the climate management system, a pump fluidly coupled to the condensate pan, and a nozzle fluidly coupled to the pump, wherein the nozzle is configured to receive the condensate from the pump and direct the condensate toward an airflow across a second heat exchanger of the climate management system.

In another embodiment of the present disclosure, a climate management system includes a condensate pan configured to collect condensate from a first heat exchanger of the climate management system, a pump fluidly coupled to the condensate pan, a nozzle fluidly coupled to the pump, wherein the nozzle is configured to receive the condensate from the pump and direct the condensate toward an airflow across a second heat exchanger of the climate management system, a sensor configured to collect and provide feedback indicative of an amount of condensate in the condensate pan, and a controller communicatively coupled to the pump and the sensor, where the controller is configured to selectively operate the pump based on feedback received from the sensor.

In a further embodiment of the present disclosure, a condensate recycling system for a climate management system includes a pump configured to generate a flow of condensate received from a condensate pan, where the condensate pan is configured to collect the condensate from a first heat exchanger of the climate management system; and a nozzle fluidly coupled to the pump, where the nozzle is configured to direct the condensate toward an airflow across a second heat exchanger of the climate management system, and where the nozzle is positioned upstream of the second heat exchanger with respect to a direction of the airflow across the second heat exchanger.

Other features and advantages of the present application will be apparent from the following, more detailed description of the embodiments, taken in conjunction with the accompanying drawings which illustrate, by way of example, the principles of the application.

DRAWINGS

DETAILED DESCRIPTION

Figure 1:
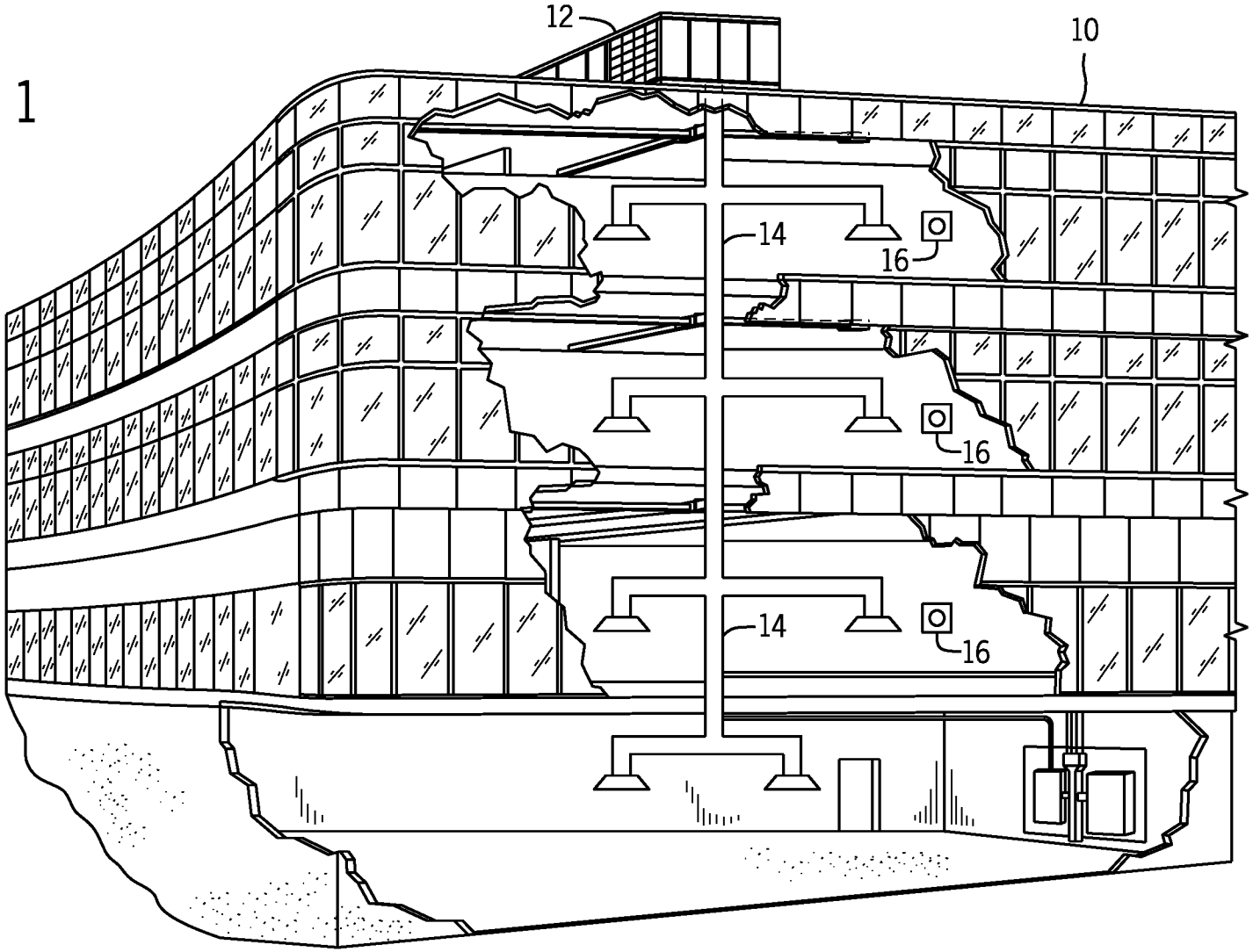
FIG. 1 is a schematic of an environmental control for building environmental management that may employ an HVAC unit, in accordance with an aspect of the present disclosure.

The present disclosure is directed to a condensate recycling system for a heating, ventilation, and air conditioning (HVAC) system. As discussed above, condensate may be generated in an outdoor unit, such as a rooftop unit, of the HVAC system as ambient air or conditioned air passes over coils of an evaporator. For instance, the coils of the evaporator are configured to circulate a working fluid that absorbs thermal energy, such as heat, from the air. In some cases, the air may include water vapor that condenses as a result of the transfer of thermal energy to the working fluid flowing through the coils of the evaporator. As such, liquid particles or droplets are formed and may be directed toward a condensate pan. In existing HVAC systems, the condensate pan may be fluidly coupled to a drainage line of a building or other structure that is conditioned by the HVAC system. Forming the connection between the condensate pan and the drainage line of the building or other structure may be time consuming and expensive.

Further, some existing HVAC systems utilize an external water supply to increase an efficiency of the system instead of recycling condensate. For instance, such HVAC systems are coupled to the external water supply that ultimately directs water over a condenser coil to increase an efficiency of the HVAC system. Unfortunately, utilizing an external water supply increases operating costs of the HVAC system. Additionally, manufacturing costs of such HVAC systems may increase because a connection to the external water supply is included to enable the external water to reach the condenser coil. In still further existing HVAC systems, such as window air conditioning units, a fan may include a slinger ring that comes into contact with condensate, such that the slinger ring directs the condensate toward a condenser coil as the fan rotates. Unfortunately, fans utilized in rooftop units for residential or commercial HVAC systems do not contact condensate, such that a slinger ring may not be utilized to direct the condensate toward the condenser coil.

As such, embodiments of the present disclosure are directed to a condensate recycling system for a HVAC unit that collects condensate and directs the condensate toward a condenser coil using a pump and spraying system. The condensate may then absorb thermal energy from air upstream of the condenser coil to pre-cool the air via adiabatic cooling. Additionally or alternatively, the condensate may be sprayed or otherwise directed toward the condenser coil to increase an amount of thermal energy absorbed by the air flowing over the condenser coil via evaporative cooling. Embodiments of the condensate recycling system disclosed herein may be particularly beneficial in warm, dry climates because air in such climates may absorb increased amounts of water when compared to air in more humid climates. In any case, a pump may be fluidly connected to the condensate pan and configured to direct the condensate toward one or more spray nozzles that spray or mist the condensate toward air and/or the condenser coil. The amount of thermal energy transferred from the working fluid flowing through the condenser to the air may be increased, which increases an efficiency of the HVAC system. Additionally, installation of the condensate recycling system may be relatively simple when compared to coupling the condensate pan to a drainage system and/or an external water supply, which may reduce assembly and/or installation costs.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
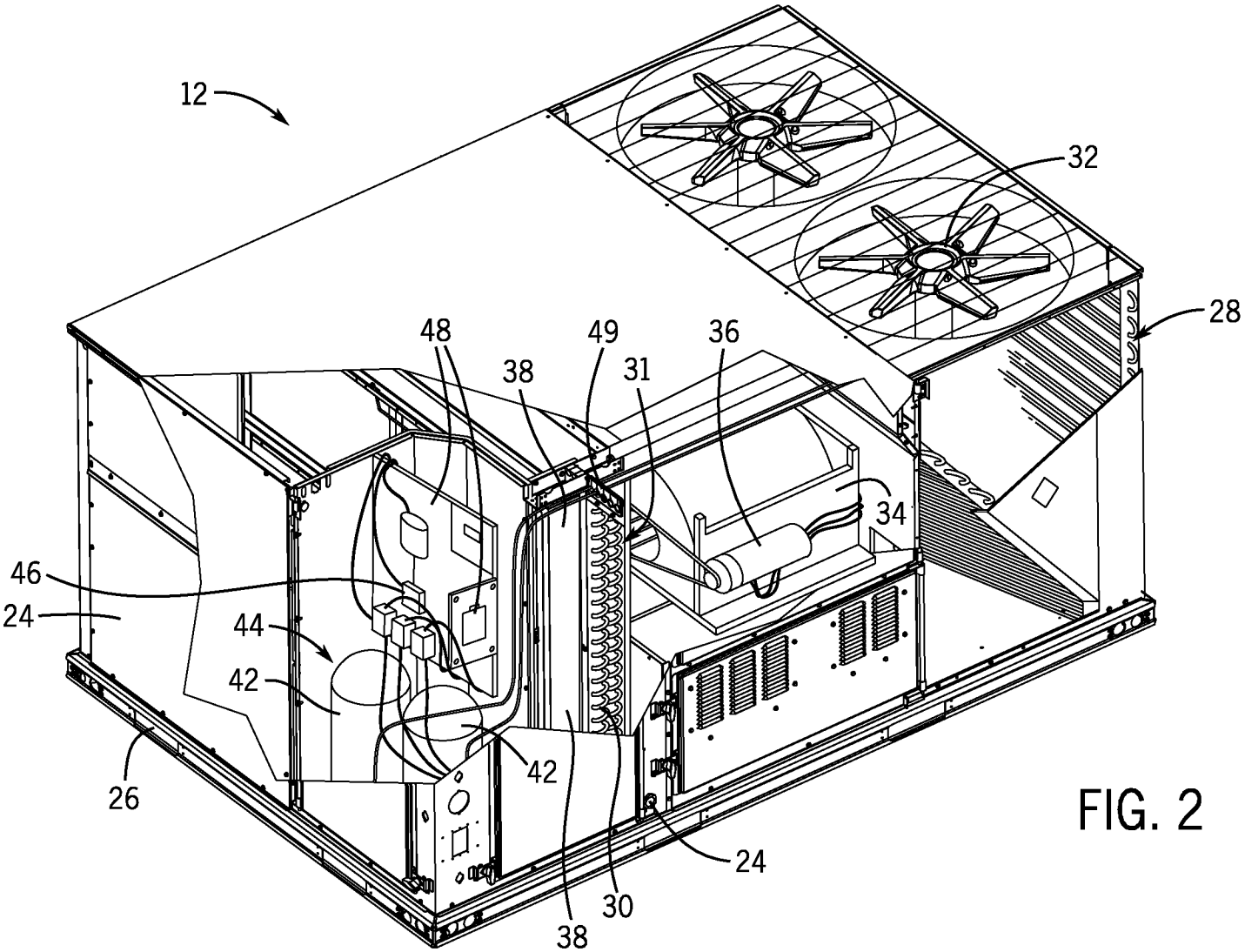
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10.

While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
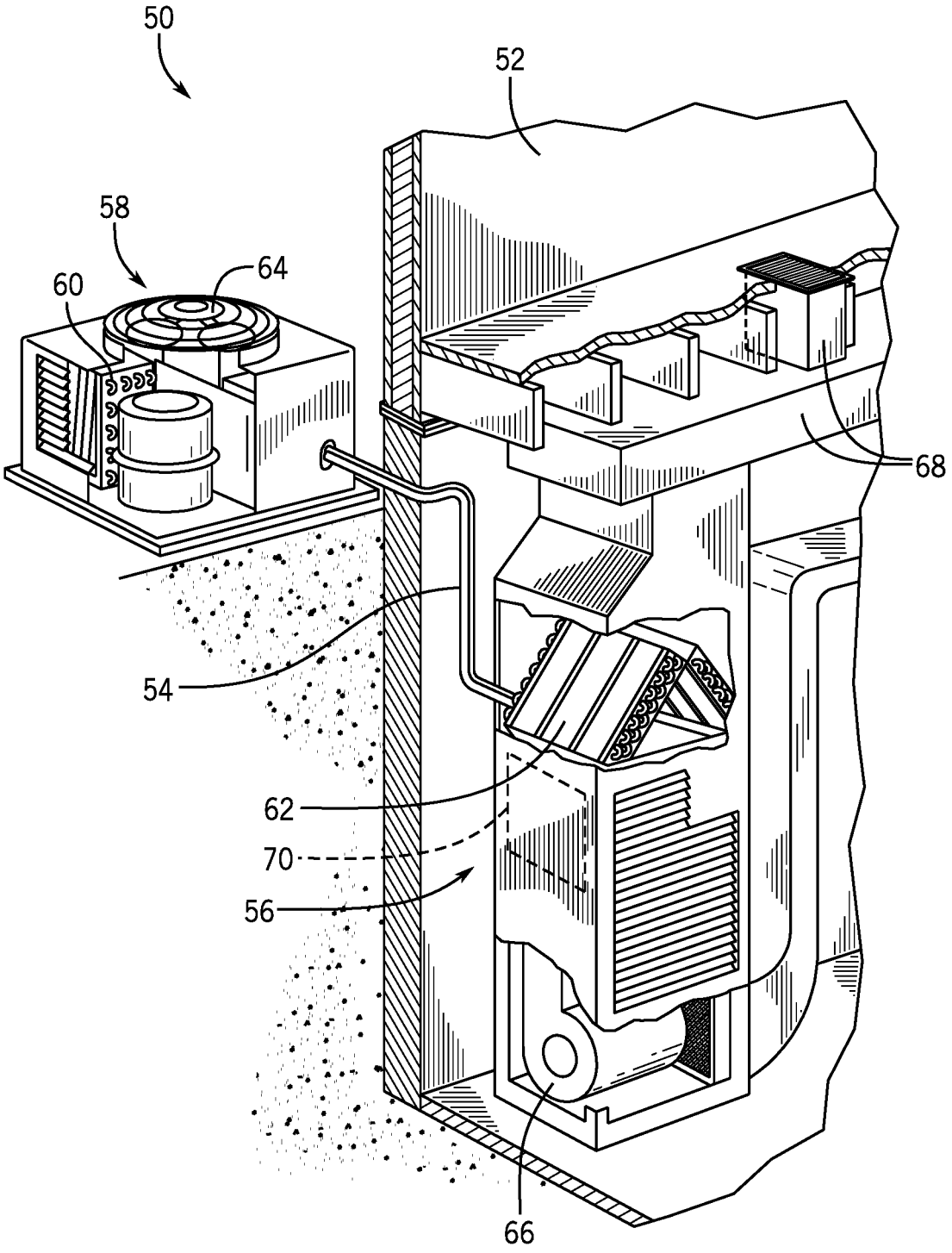
FIG. 3 is a schematic of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
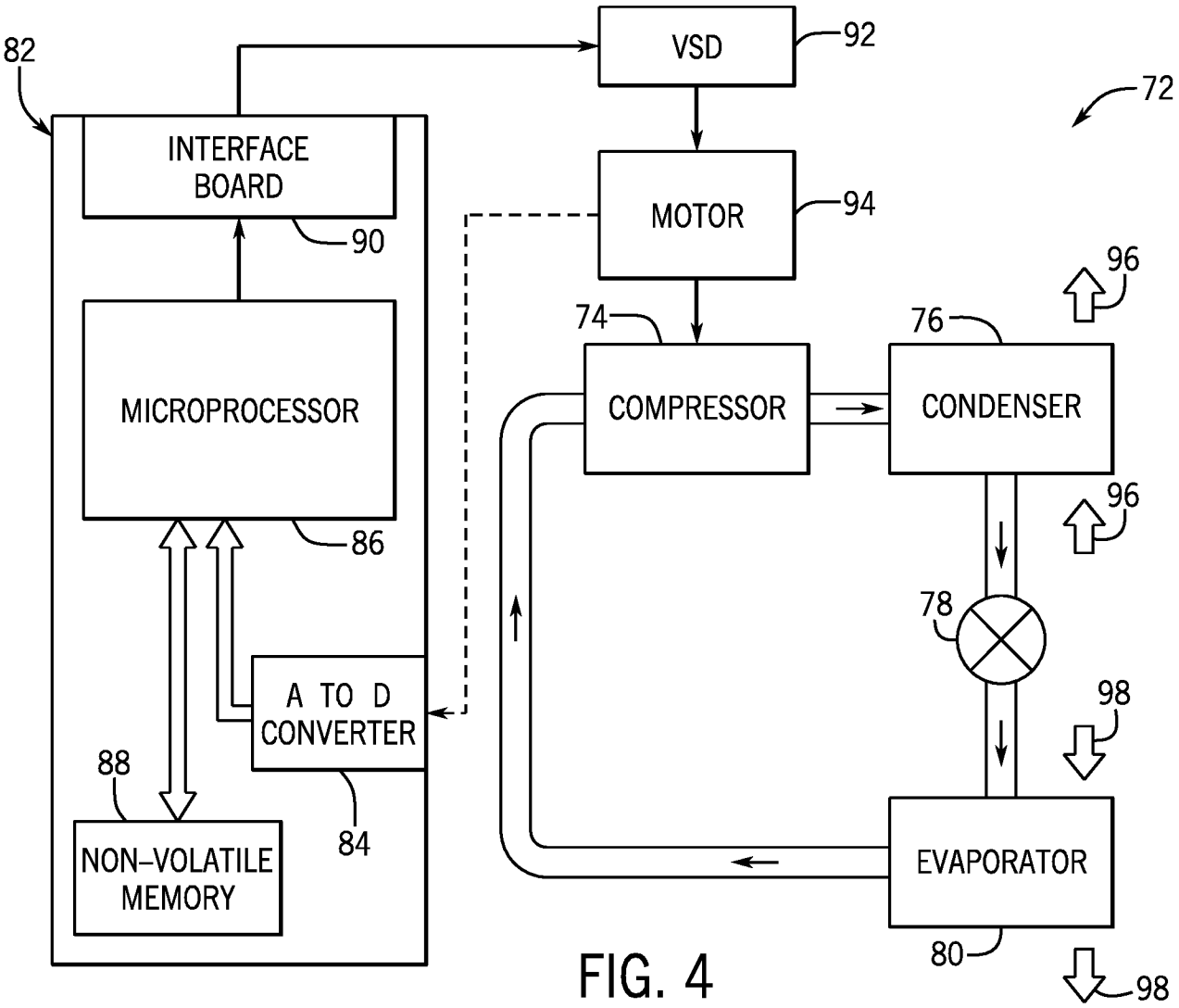
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a condensate recycling system 100 that is configured to enhance an efficiency of the HVAC unit 12, the residential heating and cooling system 50, and/or another HVAC system, which are collectively referred to as an HVAC unit 102. In some cases, condensate is generated as air transfers thermal energy, such as heat, to a working fluid flowing through an evaporator of the HVAC unit 102, such as the evaporator 80. For instance, a temperature of the air flowing across a coil of the evaporator 80 may decrease, thereby enabling water vapor to condense and generate water particles. The water particles may have a relatively low temperature, and thus, may be utilized to pre-cool air that is configured to flow across a condenser, such as the condenser 76, via adiabatic cooling. Additionally or alternatively, the water particles may be directly disposed or distributed over coils of the condenser 76 to increase an amount of thermal energy transferred from the working fluid to the air in the condenser 76 via evaporative cooling.

Figure 5:
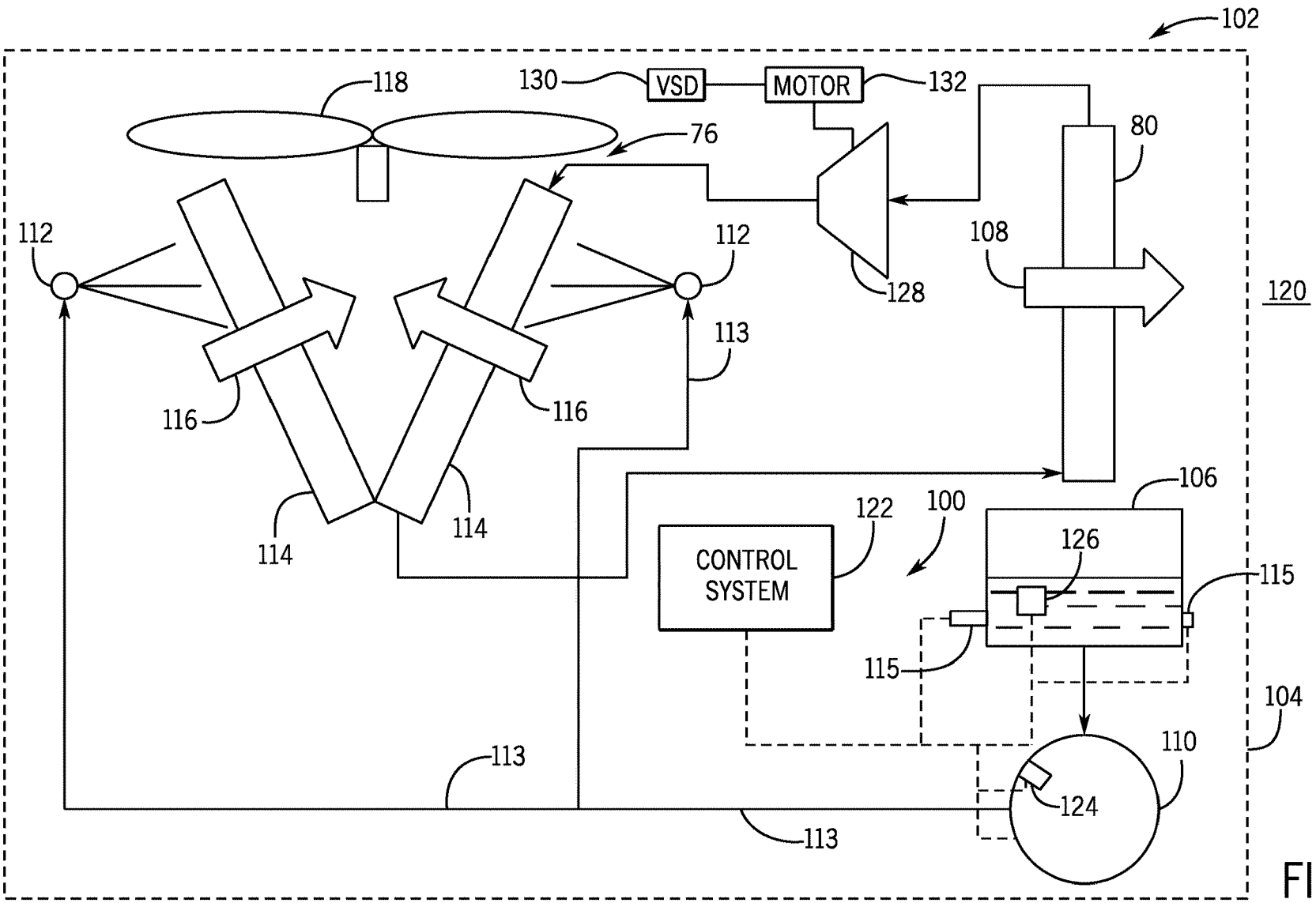
FIG. 5 is a schematic of an embodiment of a condensate recycling system for any of the HVAC units of FIGS. 1-3, in accordance with an aspect of the present disclosure.

For example, FIG. 5 is a schematic of an embodiment of the condensate recycling system 100 for the HVAC unit 102. In some embodiments, the HVAC unit 102 is a single-packaged rooftop unit that includes the condenser 76 and the evaporator 80 in a common, or single, housing 104. While the condenser 76 is illustrated as having two coils in a V-shape arrangement, it should be recognized that the condenser 76 may have any suitable coils in any suitable arrangement, such as wrap-around vertical coils, other suitable coils, or any combination thereof. Additionally, in some embodiments, a condensate pan 106 may be disposed in the common housing 104 to collect condensate that forms as air 108 flows across coils of the evaporator 80. In other embodiments, the condensate pan 106 is disposed external to the common housing 104 and is configured to receive the condensate via a drain of the housing 104. In any case, the condensate pan 106 is fluidly coupled to a pump 110. For instance, condensate from the condensate pan 106 may be directed toward the pump 110 via gravitational force and/or via a suction pressure created by operation of the pump 110.

As shown in the illustrated embodiment of FIG. 5, the HVAC unit 102 includes nozzles 112 that are fluidly coupled to the pump 110 via conduits 113 and are thus configured to receive condensate from the pump 110. As used herein, the nozzles 112 may include sprayers, misters, dripper systems, wicks, the conduits 113 that route condensate from the pump 110 to an outlet of the nozzles 112, and/or other suitable components configured to direct and/or distribute the condensate toward the condenser 76. While FIG. 5 illustrates the HVAC unit 102 having two nozzles 112, it should be recognized that the HVAC unit 102 may include one, three, four, five, six, seven, eight, nine, ten, or more of the nozzles 112. In any case, the nozzles 112 spray, mist, and/or otherwise direct condensate generally toward coils 114 of the condenser 76. In some embodiments, the condensate pan 106 may include substances or materials that treat the condensate to remove algae or other contaminants that may clog the nozzles 112 and/or conduits 113 directing the condensate toward the coils 114. For example, injectors 115 may be fluidly coupled to the condensate pan 106 and may be configured to inject various substances into the condensate pan 106 to remove the contaminants from the condensate.

The nozzles 112 may be positioned upstream of the coils 114 of the condenser 76 with respect to a flow of air 116 configured to flow across the coils 114 of the condenser 76. For example, a fan 118 is utilized to draw the flow of air 116 from an environment 120 surrounding the HVAC unit 102 across the coils 114 of the condenser 76. As such, the condensate may absorb thermal energy from the flow of air 116 via adiabatic cooling, thereby precooling the flow of air 116 before the flow of air 116 reaches the coils 114. As a result of the reduced temperature of the flow of air 116, the flow of air 116 may absorb an increased amount of thermal energy from the working fluid flowing through the coils 114, thereby increasing an efficiency of the HVAC unit 102. In some embodiments, the condensate does not contact the coils 114 of the condenser 76, but is sprayed into the air 116 upstream of the coils 114 with respect to the flow of air 116 through the condenser 76. In other embodiments, some or substantially all of the condensate directed toward the coils 114 may reach the coils 114 and accumulate on external surfaces of the coils 114. Accordingly, the condensate may further increase an amount of thermal energy transferred from the working fluid to the flow of air 116 via evaporative cooling.

In some embodiments, the HVAC unit 102 includes a control system 122, such as the control board 48 and/or the control panel 82. The control system 122 may be communicatively coupled to a level sensor 124 that is configured to provide feedback indicative of an amount of condensate within the condensate pan 106. As shown in the illustrated embodiment of FIG. 5, the level sensor 124 is included or integrated into the pump 110. However, in other embodiments, the level sensor 124 may be disposed in, or otherwise coupled to, the condensate pan 106 and may be configured to directly monitor an amount of condensate in the condensate pan 106. Further, the control system 122 may be communicatively coupled to the pump 110, such that the control system 122 is configured to selectively operate the pump 110 based on feedback received from the level sensor 124 and/or another sensing device of the HVAC unit 102. For example, the control system 122 may receive feedback indicative of an operating mode of the HVAC unit 102, such as a heating mode or a cooling mode, from a sensing device or other component of the HVAC unit 102. In some embodiments, the control system 122 may receive feedback indicative of a temperature of ambient air, feedback indicative of a temperature within a conditioned space, feedback indicative of power supplied to a compressor, feedback indicative of another suitable parameter of the HVAC unit 102, or any combination thereof, to determine whether the HVAC unit 102 operates in the heating mode or the cooling mode. Further, the control system 122 may receive feedback indicative of an amount of condensate collected in the condensate pan 106. Further still, the control system 122 may receive feedback indicative of a temperature of the condensate and/or another suitable parameter.

When the control system 122 determines that the HVAC unit 102 operates in the cooling mode and that the condensate pan 106 includes at least a target level of condensate, the control system 122 may activate the pump 110 to motivate or drive the condensate toward the coils 114 of the condenser 76 and/or to the flow of air 116 via the conduits 113 and nozzles 112. Generally, when the HVAC unit 102 operates in the cooling mode, condensate generated at the evaporator 80 may have a relatively low temperature, such as between 50 degrees Fahrenheit (° F.) and 70° F., between 55° F. and 65° F., or between 57° F. and 62° F. The condensate may thus be utilized to absorb thermal energy from the flow of air 116 and/or the working fluid flowing through the coils 114 of the condenser 76 to enhance an amount of thermal energy transfer performed by the condenser 76. As such, the condensate recycling system 100 increases an efficiency of the HVAC unit 102. In some embodiments, the condensate recycling system 100 may increase a coefficient of performance of the HVAC unit 102 by between 1% and 10%, between 2% and 8%, or between 4% and 6% when compared to existing HVAC units or other HVAC units without the condensate recycling system 100 described herein.

Conversely, when the control system 122 determines that the HVAC unit 102 operates in the heating mode and/or that the condensate pan 106 does not include at least the target level of condensate, the control system 122 may deactivate, or shut down, the pump 110. When the pump 110 is deactivated and/or shut down, condensate may not be drawn from the condensate pan 106 and directed to the nozzles 112 to be distributed over the coils 114 of the condenser 76 and/or into the flow of air 116. Additionally or alternatively, the control system 122 may be configured to shut down the pump 110 when the feedback from the level sensor 124 indicates that the amount of condensate within the condensate pan 106 has fallen below the target amount.

Further still, the control system 122 may be communicatively coupled to the injectors 115 and configured to control an amount of a substance or material injected into the condensate pan 106. For instance, a composition sensor 126 may be disposed within the condensate pan 106 and may be configured to provide feedback indicative of concentration levels of various components in the condensate, such as algae. When the feedback indicates that the concentration level of a target or monitored component exceeds a target level, the control system 122 may activate the injectors 115 to inject the substance into the condensate pan 106. The control system 122 may be configured to determine an amount of the substance, an amount of time that the injectors 115 are activated, or another suitable parameter based on the concentration level of the target component. As such, the concentration level of the target or monitored component may be adjusted, such that the condensate does not clog or otherwise foul the pump 110 and/or the conduits 113 coupling the condensate pan 106 to the nozzles 112.

As set forth above, the HVAC unit 102 may further include a compressor 128, such as the compressor 42 and/or the compressor 74. A speed of the compressor 128 may be adjusted using a variable speed drive 130 that varies an amount of power supplied to a motor 132 of the compressor 128. In some embodiments, the condensate recycling system 100 may improve a performance of the compressor 128. For instance, the compressor 128 may be designed to compress the working fluid to circulate the working fluid throughout a circulation loop, such as a refrigerant loop, of the HVAC unit 102. As the pressure of the working fluid in the circulation loop of HVAC unit 102 increases, an amount of power supplied to the compressor 128 also increases in order for the compressor 128 to sufficiently circulate the working fluid between the evaporator 80 and the condenser 76 and throughout the circulation loop. The condensate recycling system 100 lowers the pressure of the working fluid within the circulation loop of the HVAC unit 102 by reducing a temperature of the working fluid in the condenser 76. Using a variable speed drive to adjust a speed of the compressor 128 may enable a speed of the compressor 128 to be reduced as the pressure in the circulation loop of the HVAC unit 102 decreases. The reduced speed of the compressor 128 reduces an amount of power supplied to the compressor 128, which may increase an efficiency of the HVAC unit 102.

Further, the variable speed drive 130 enables the compressor 128 to run longer to match a load demand during part load conditions. The longer run time of the compressor 128 enables substantially continuous dehumidification of the air 108 flowing across the evaporator 80, which may increase an amount of condensate available for use in the condensate recycling system 100. Increasing the amount of condensate enables the condensate recycling system 100 to operate at part load conditions, which may further increase an efficiency of the HVAC unit 102.

Figure 6:
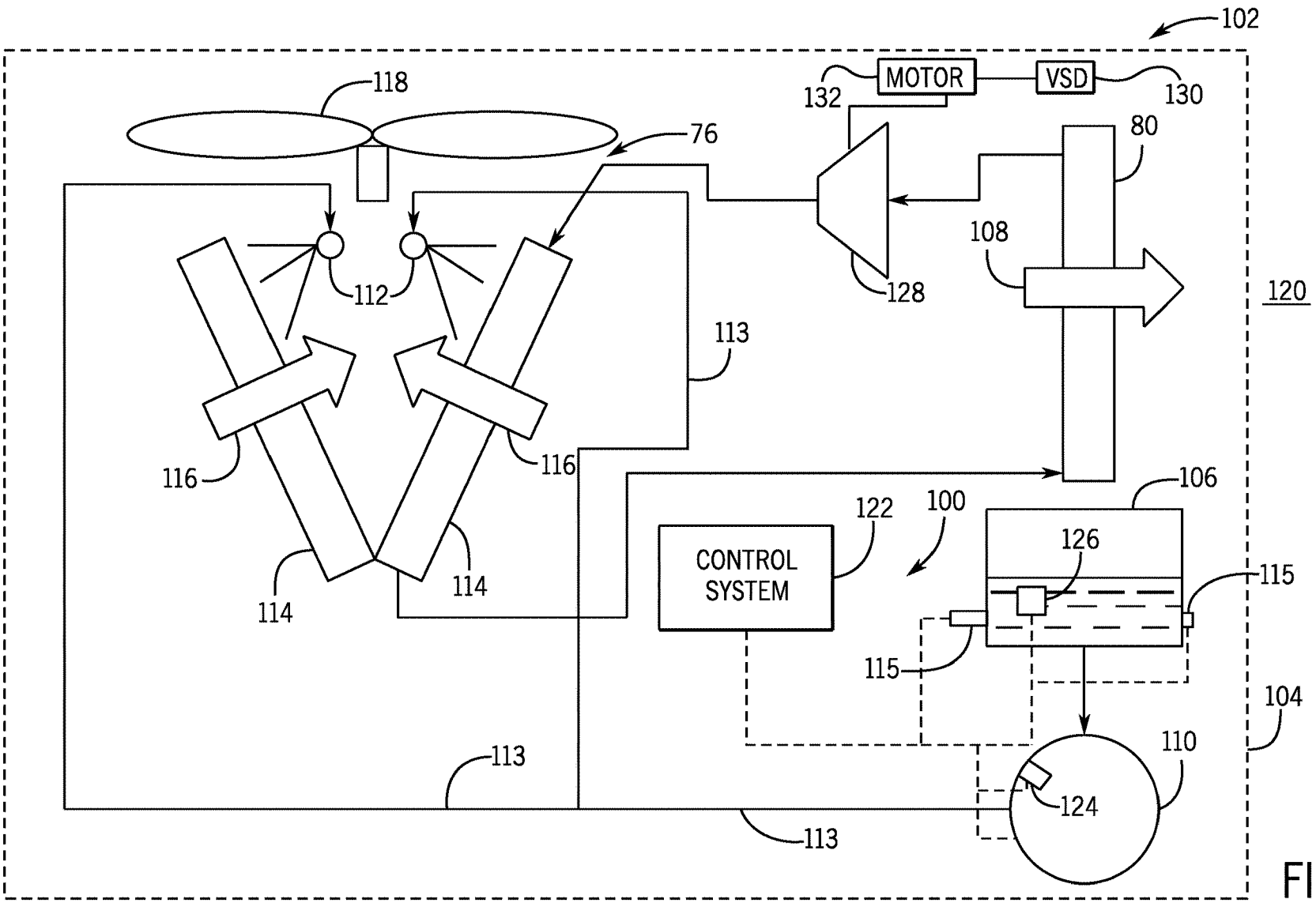
FIG. 6 is a schematic of an embodiment of the condensate recycling system for any of the HVAC units of FIGS. 1-3, in accordance with an aspect of the present disclosure.

FIG. 6 is a schematic of an embodiment of the condensate recycling system 100 where the nozzles 112 are positioned downstream of the coils 114 of the condenser 76 with respect to the flow of air 116 across the coils 114. In such embodiments, the condensate may be directly sprayed, misted, dripped, or otherwise disposed over external surfaces of the coils 114. As such, the condensate may increase an amount of thermal energy transferred between the working fluid flowing through the coils 114 and the flow of air 116 via evaporative cooling. In the embodiment illustrated in FIG. 6, the condensate exiting the nozzles 112 may not precool the flow of air 116 prior to the flow of air 116 reaching the coils 114. However, in some cases, condensate may fall through the coils 114 and enable the flow of air 116 to transfer thermal energy to the condensate via adiabatic cooling before the flow of air 116 reaches the coils 114.

As set forth above, embodiments of the present disclosure may provide one or more technical effects useful in increasing an efficiency of HVAC systems. For example, embodiments of the present disclosure are directed to a condensate recycling system configured to distribute condensate toward a condenser coil and/or an airflow across the condenser coil to increase an amount of thermal energy released from a working fluid in the condenser coil. The condensate may be generated at an evaporator coil and collected in a condensate pan. The condensate pan may be fluidly coupled to a pump, which may direct the condensate toward nozzles that enable the condensate to be distributed over the condenser coil and/or within the airflow across the condenser coil. As such, the temperature of the working fluid flowing through the condenser coil may be reduced via evaporative cooling and/or the temperature of the airflow across the condenser coil may be reduced via adiabatic cooling, which increases an efficiency of the system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A climate management system, comprising:

a condensate pan configured to collect condensate directly from a first heat exchanger of the climate management system;

a pump fluidly coupled to the condensate pan and configured to receive the condensate from the condensate pan; and a nozzle fluidly coupled to the pump, wherein the nozzle is configured to receive the condensate from the pump and direct the condensate toward an airflow across a second heat exchanger of the climate management system, wherein the first heat exchanger and the second heat exchanger are fluidly coupled along a common refrigerant circuit.

2. The climate management system of claim 1, wherein the condensate pan, the first heat exchanger, and the second heat exchanger are packaged together in a single housing.

3. The climate management system of claim 1, wherein the second heat exchanger comprises a first coil and a second coil arranged in a V-shape.

4. The climate management system of claim 3, comprising an additional nozzle fluidly coupled to the pump and configured to receive the condensate from the pump, wherein the nozzle is configured to direct the condensate toward the first coil of the second heat exchanger, and wherein the additional nozzle is configured to direct the condensate toward the second coil of the second heat exchanger.

5. The climate management system of claim 1, comprising a controller communicatively coupled to the pump and configured to selectively operate the pump based on feedback received from a sensor.

6. The climate management system of claim 5, comprising the sensor communicatively coupled to the controller, wherein the sensor is configured to measure an amount of the condensate in the condensate pan, and the controller is configured to selectively operate the pump based on the amount of the condensate in the condensate pan.

7. The climate management system of claim 6, wherein the controller is configured to activate the pump when the feedback received from the sensor indicates that the amount of the condensate in the condensate pan exceeds a threshold amount.

8. The climate management system of claim 1, comprising a fan configured to draw the airflow across the second heat exchanger.

9. The climate management system of claim 8, wherein the nozzle is configured to direct the condensate into the airflow upstream of the second heat exchanger relative to the airflow across the second heat exchanger.

10. The climate management system of claim 8, wherein the nozzle is configured to direct the condensate into the airflow downstream of the second heat exchanger relative to the airflow across the second heat exchanger.

11. The climate management system of claim 1, wherein the first heat exchanger comprises an evaporator, and wherein the second heat exchanger comprises a condenser.

12. The climate management system of claim 11, wherein the evaporator is configured to absorb heat from a flow of air passing across the evaporator, wherein the climate management system is configured to direct the flow of air into a building to condition an environment within the building.

13. The climate management system of claim 1, wherein the nozzle comprises a sprayer, a mister, a dripper system, or any combination thereof.

14. The climate management system of claim 1, wherein the condensate pan comprises a treatment system configured to remove contaminants from the condensate, wherein the treatment system comprises:

a composition sensor configured to collect and provide feedback indicative of a concentration level of a component within the condensate; and a controller configured to receive the feedback and to instruct an injector to inject a substance into the condensate pan based on the concentration level.

15. A climate management system, comprising:

a condensate pan disposed directly beneath a first heat exchanger of the climate management system and configured to collect condensate from the first heat exchanger;

a pump fluidly coupled to the condensate pan;

a nozzle fluidly coupled to the pump, wherein the nozzle is configured to receive the condensate from the pump and direct the condensate toward an airflow across a second heat exchanger of the climate management system, wherein the first heat exchanger and the second heat exchanger are fluidly coupled along a common refrigerant circuit;

a sensor configured to collect and provide feedback indicative of an amount of the condensate in the condensate pan; and a controller communicatively coupled to the pump and the sensor, wherein the controller is configured to operate the pump based on the feedback received from the sensor.

16. The climate management system of claim 15, wherein the controller is configured to activate the pump when the feedback received from the sensor indicates that the amount of the condensate in the condensate pan exceeds a threshold amount.

17. The climate management system of claim 16, wherein the controller is configured to shut down the pump when the feedback received from the sensor indicates that the amount of the condensate in the condensate pan reaches or falls below the threshold amount.

18. The climate management system of claim 15, wherein the condensate pan, the first heat exchanger, and the second heat exchanger are packaged in a rooftop unit.

19. The climate management system of claim 15, wherein the condensate pan comprises a treatment system configured to remove contaminants from the condensate, wherein the treatment system comprises a composition sensor configured to collect and provide additional feedback indicative of a concentration level of a component within the condensate, and wherein the controller is configured to receive the additional feedback and to instruct an injector to inject a substance into the condensate pan based on the concentration level.

20. A condensate recycling system for a climate management system, comprising:

a condensate pan configured to collect condensate generated via a first heat exchanger that is fluidly coupled to a second heat exchanger along a common refrigerant circuit of the climate management system, wherein a flow path of the condensate from the first heat exchanger into the condensate pan is independent of the second heat exchanger;

a pump configured to generate a flow of the condensate collected by the condensate pan; and a nozzle fluidly coupled to the pump, wherein the nozzle is configured to receive the flow of the condensate from the pump and direct the flow of the condensate toward an airflow directed across the second heat exchanger, and wherein the nozzle is positioned upstream of the second heat exchanger with respect to a direction of the airflow directed across the second heat exchanger.

21. The condensate recycling system of claim 20, comprising a sensor configured to provide feedback indicative of an amount of the condensate in the condensate pan.

22. The condensate recycling system of claim 21, comprising a controller communicatively coupled to the sensor and the pump, wherein the controller is configured operate the pump based on the feedback received from the sensor.

23. The condensate recycling system of claim 22, wherein the controller is configured to activate the pump when the feedback received from the sensor indicates that the amount of the condensate in the condensate pan exceeds a threshold amount.

24. The climate management system of claim 14, wherein the controller is configured to control an amount of the substance injected into the condensate pan or an amount of time that the injector is activated based on the concentration level.

* * * * *